United States Patent [19]

Ezernack et al.

[11] Patent Number: 4,695,367

[45] Date of Patent: Sep. 22, 1987

[54] DIESEL FUEL PRODUCTION

[75] Inventors: Daniel D. Ezernack, Sugarland; Robert B. Armstrong, Katy, both of Tex.

[73] Assignee: The M. W. Kellogg Company, Houston, Tex.

[21] Appl. No.: 843,442

[22] Filed: Mar. 24, 1986

[51] Int. Cl.[4] ..... C09C 1/48

[52] U.S. Cl. ..... 208/106; 208/131; 208/52 R

[58] Field of Search ..... 208/131, 106, 52 R, 208/55, 53, 54, 68, 15

[56] References Cited

U.S. PATENT DOCUMENTS

| | | | |
|---|---|---|---|
| 1,688,860 | 10/1928 | Egloff . | |
| 1,712,187 | 5/1929 | Wilson . | |
| 1,748,065 | 2/1930 | Egloff et al. . | |
| 1,900,170 | 3/1933 | Egloff . | |
| 1,920,331 | 8/1933 | Warwick | 208/131 |
| 1,933,507 | 10/1933 | Peck | 208/131 |
| 2,039,763 | 5/1936 | Andrews et al. | 208/131 |
| 2,103,561 | 12/1937 | Smith | 196/49 |
| 2,170,333 | 8/1939 | Kramer | 208/131 |
| 2,626,892 | 1/1953 | McCulley et al. | 208/131 |
| 2,687,986 | 8/1954 | Jennings et al. | 196/49 |
| 2,717,865 | 9/1955 | Kimberlin, Jr. et al. | 208/131 |
| 2,748,061 | 5/1956 | Olberg et al. | 196/50 |
| 2,752,290 | 6/1956 | Beattie | 208/131 |
| 3,687,840 | 8/1972 | Sze et al. | 208/131 |
| 3,707,459 | 12/1972 | Mason et al. | 208/76 |
| 4,049,538 | 9/1977 | Hayashi et al. | 208/131 X |
| 4,177,133 | 12/1979 | Hayashi et al. | 208/131 X |
| 4,199,434 | 4/1980 | Sze et al. | 208/131 X |
| 4,247,387 | 1/1981 | Akbar | 208/131 X |
| 4,400,264 | 8/1983 | Kwant et al. | 208/68 |
| 4,428,823 | 1/1984 | Hessler et al. | 208/106 X |
| 4,443,325 | 4/1984 | Chen et al. | 208/55 |
| 4,477,334 | 10/1984 | Gomi et al. | 208/75 |
| 4,519,898 | 5/1985 | Allan | 208/131 |
| 4,522,703 | 6/1985 | Yan et al. | 208/106 |

*Primary Examiner*—Andrew Metz
*Assistant Examiner*—Glenn Caldarola

[57] ABSTRACT

Diesel range fuel is produced in excess of gasoline range fuel from virgin hydrocarbon oils having low carbon content by heat soaking under mild thermal cracking conditions carried out at low pressure wherein the cracked fractions are removed substantially as they are formed.

6 Claims, 3 Drawing Figures

DIESEL FUEL PRODUCTION

This invention relates to the production of hydrocarbon middle distillates boiling in the diesel fuel range.

Historically, refinery operations have been principally directed to production of motor gasoline by blends of products from, for example, fluid catalytic cracking, hydrocracking, thermal cracking, and crude oil distillations. To varying degrees, middle distillates are a by-product of these processes but are frequently employed as feedstocks for naphtha range product units because of relatively limited demand for residential heating oil, diesel fuel, lube oils, and the like. In recent years, however, the market mix for motor fuels has changed in that gasoline demand has leveled off while diesel fuel demand has continued to rise. This trend in motor fuel product slate is difficult to accommodate in refinery operations because increasing production of diesel fuel usually requires significant increases in production of undesired gasoline blending stocks.

It is, therefore, an object of this invention to provide a continuous process for production of hydrocarbons boiling in the diesel fuel range without correspondingly larger increases in co-production of gasoline.

According to the invention, virgin hydrocarbon oil, that is oil not previously subjected to cracking, is heat soaked in the liquid phase at a temperature between 385° C. and 440° C. and within the critical pressure range between 1.38 and 3.84 kg/cm$^2$ abs. Heated oil is maintained in the soaking zone as a heavy oil liquid portion for an average residence time equivalent to from 1 to 4 hours on a fresh feed basis. Under these conditions, the liquid phase undergoes mild thermal cracking to evolve a vapor phase rich in hydrocarbons boiling in the diesel fuel range. The vapor phase is withdrawn from the soaking zone substantially as it is formed from the liquid phase heavy oil and passed directly to a fractionation zone for recovery of a diesel range fuel product. No hydrogen is introduced to the soaking zone.

The process of the invention and the feedstock are intimately related inasmuch as we have found that virgin oils having a Conradson carbon content below 2 weight percent and boiling predominantly above 345° C. contain a good distribution of moderately heavy molecules which may be thermally cracked under mild conditions without forming excessive amounts of light ends and coke. The Conradson test for measurement of carbon residues in hydrocarbons is well known. The virgin oils may be taken directly from atmospheric or vacuum distillation towers as atmospheric residuum or vacuum gas oil. Preferred feedstocks are vacuum gas oils boiling between 345° C. and 565° C.

The oil feed is heated to incipient cracking temperature near or within the stated ranges in, typically, a conventional refinery furnace. Care should be taken that feed residence time in the furnace be minimized to ensure that significant coking does not occur on the hot tube walls. Typically, the furnace outlet temperature will be between 415° C. and 510° C.

The resulting heated oil is then transferred to a back-mixed soaking zone having a vapor zone in the upper portion thereof and a liquid zone in the lower portion. The soaking zone is operated within the ranges of temperature, residence time, and pressure stated above, however, the critical pressure range refers to vapor zone pressure. The soaking zone may be a vertical, cylindrical, low-pressure vessel preferably provided with means such as a pump-around to augment internal back-mixing which will naturally occur in this configuration. Alternatively, part of the heavy oil in the soaker may be recirculated through the furnace if necessary to maintain desired temperature in the soaking zone.

Figure 1:
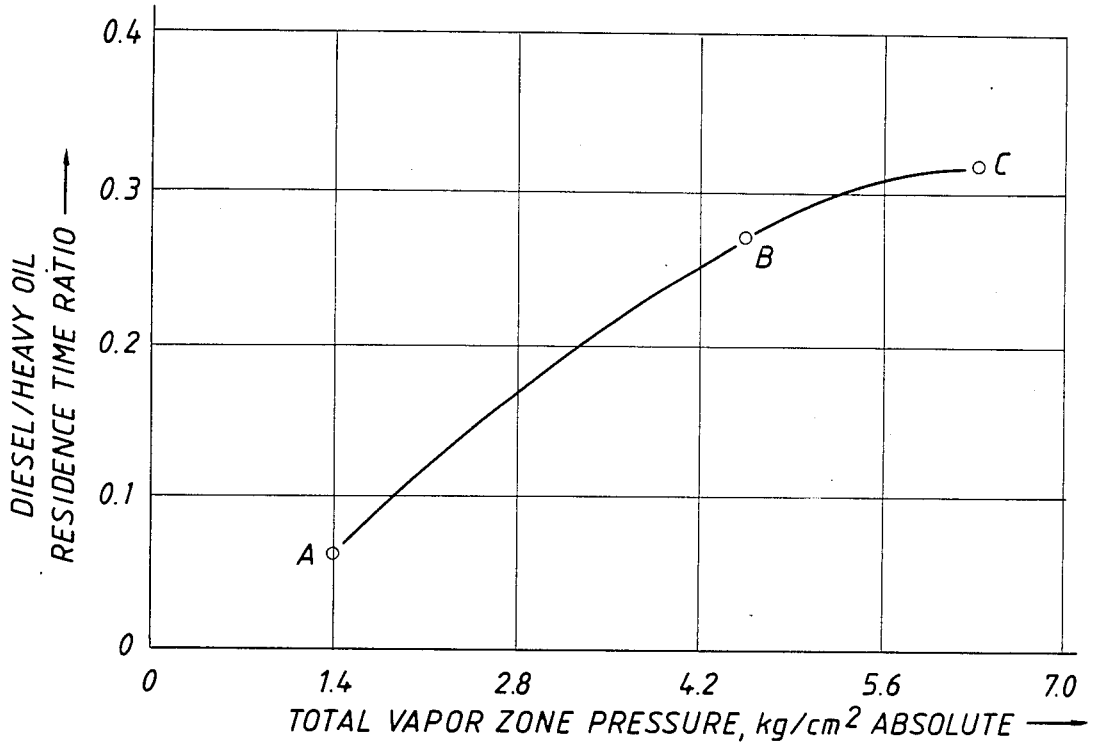
FIG. 1 is a graph showing the relationship between soaking zone pressure and the ratio of residence time in the soaking zone between the diesel fraction and the heavy oil.
Figure 2:
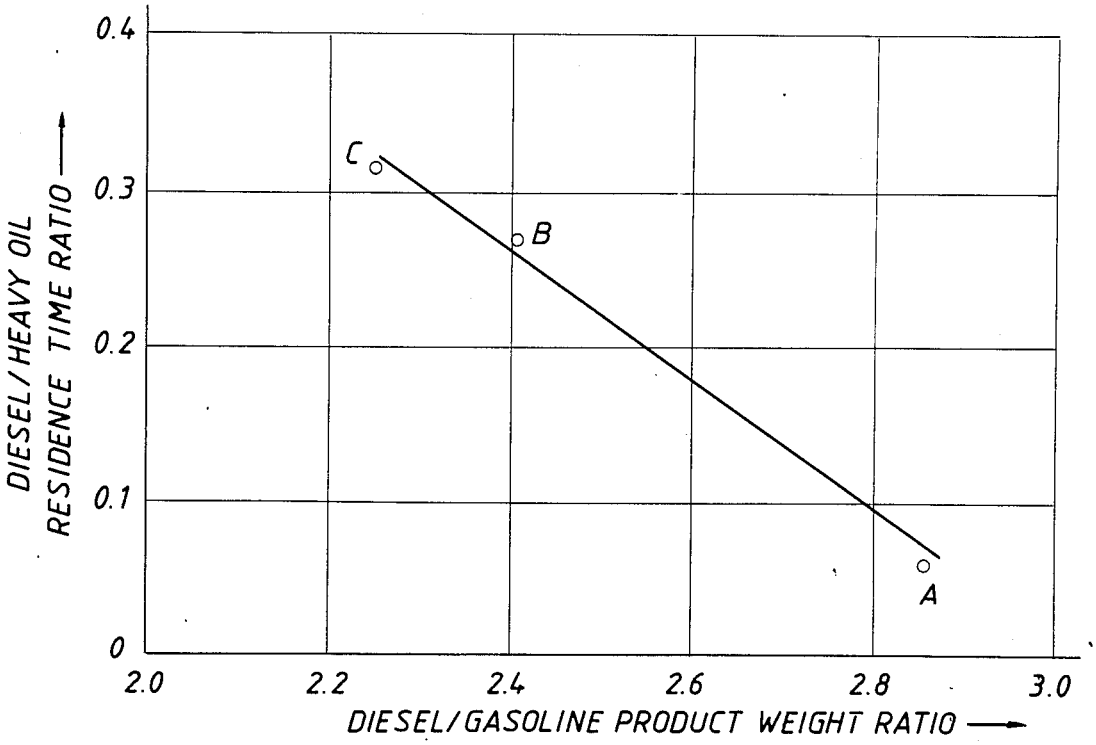
FIG. 2 is a graph showing the relationship between the residence time ratio described above and the diesel to gasoline product ratio.

Unlike conventional thermal cracking techniques for gasoline production, the soaking zone is maintained at single equilibrium flash vaporization conditions in which the diesel component is removed from the soaking zone substantially as it is formed. Despite this difference, the usual residence time and temperature parameters in thermal cracking operations will not, alone, bring about the desired increase in diesel/gasoline product ratio. As illustrated in FIG. 2, we have found that conversion to diesel range product in excess of gasoline range product is favored by decreasing the ratio of residence time of the diesel range component in the soaking zone with respect to residence time of the heavy oil in the soaking zone. The diesel/heavy oil residence time ratio may be approximated from flash calculations. Moreover, we have found that the diesel/-heavy oil residence time ratio is a pressure dependent function as illustrated in FIG. 1. At risk of oversimplification, the ultimate diesel/ gasoline product ratio, therefore, is also a pressure dependent function with higher diesel make favored by lower pressure.

These effects may be expressed in the following relationships:

$$D/G = -2.3\ R_t + 3 \quad (1)$$

$$R_t = T_d/T_o \quad (2)$$

$$T_d = (W_{dv} \cdot T_v + W_{dl} \cdot T_l)/(W_{dv} + W_{dl}) \quad (3)$$

$$T_o = (W_{ov} \cdot T_v + W_{ol} \cdot T_l)/(W_{ov} + W_{ol}) \quad (4)$$

where, in the soaking zone:

$D/G$ = diesel/gasoline product weight ratio $R_t$ = diesel/heavy oil (345° C.+) residence time ratio $T_d$ = diesel residence time $T_o$ = heavy oil (345° C.+) residence time $W_{dv}$ = weight rate of diesel leaving in overhead vapor $W_{dl}$ = weight rate of diesel leaving in liquid portion $W_{ov}$ = weight rate of heavy oil leaving in overhead vapor $W_{ol}$ = weight rate of heavy oil leaving in liquid portion $T_v$ = residence time of overhead vapor $T_l$ = residence time of liquid Referring again to FIGS. 1 and 2, one might expect that a very high diesel/gasoline product ratio would result from vacuum or very low pressure operation of the soaking zone. This is not feasible because the diesel fraction flash temperature declines with pressure. Since the cracking rate declines directly, although not linearly, with temperature, the low end of the soaking zone operating pressure is effectively limited to 1.38 kg/cm$^2$ abs. At the other extreme, the curve of FIG. 1 tends to flatten off with increasing pressure and it may appear that high pressure operation, while undesirable, could be tolerable. This is also not feasible because higher pressure operation requires a higher diesel flash temperature and therefore a higher soaking zone temperature which, in turn, brings about a higher rate of coke formation in the soaker. In order to maintain coke formation rate below acceptable levels, therefore, the high end of the soaking zone operating pressure is limited to 3.84 kg/cm$^2$ abs.

The data points illustrated in FIGS. 1 and 2 were developed from the following laboratory runs.

EXAMPLE

A North Slope vacuum gas oil having an initial boiling point of 332° C., an end point of 575° C., and a volume average boiling point of 446° C. was employed as feedstock in the runs tabulated below. The feed had a sulfur content of 1.3 weight percent, however, the Conradson carbon content was too low to measure. No catalyst was employed.

A 300 cc stirred reactor fitted with dip tube for withdrawal of liquid and gaseous products was used in the experiments. The reactor vapor space was purged with nitrogen. Hydrocarbons removed from the reactor were quenched to ambient conditions and passed to a gas/liquid separator. After reactor heat-up, runs were conducted for 6–7 hours with total gas make and analysis continuously determined while liquid products were weighed each hour. Liquid samples were analyzed at two-hour intervals. The products' vapor-liquid equilibrium at run conditions was calculated by thermodynamic equilibrium flash calculation. Results of the runs and calculations are tabulated below.

TABLE 1

| Run No. | 21 | 17 | 14 | 14* |
|---|---|---|---|---|
| FIGS. 1 & 2 Reference Point | A | B | — | C |
| Temperature, °C. | 413 | 413 | 423 | 413 |
| Pressure, kg/cm$^2$ abs. | 1.38 | 4.55 | 6.30 | 6.30 |
| Liq. Hrly. Space Vel., 1/hr. | 0.52 | 0.48 | 0.52 | 0.52 |
| Yields, Weight %: | | | | |
| Light Ends | 2.3 | 2.7 | 4.5 | 3.0 |
| C5–193° C. (Gasoline) | 8.2 | 9.3 | 15.5 | 9.7 |
| 193° C.–343° C. (Diesel) | 23.5 | 22.5 | 31.2 | 21.8 |
| 343° C. + | 65.9 | 65.5 | 48.8 | 65.5 |
| Total | 99.9 | 100.0 | 100.0 | 100.0 |
| Diesel/Gasoline Ratio | 2.86 | 2.41 | 2.01 | 2.25 |
| $R_f$ (Diesel/Heavy Oil) | 0.059 | 0.27 | 0.33 | 0.32 |
| Residence Time Ratio | | | | |

*Yields and ratios for Run 14 were adjusted in the calculations for operation at comparable temperature of 413° C.

The overhead vapor from the soaking zone contains the bulk of the diesel fraction made in the process. In order to prevent a significant amount of cracking of this fraction, residence time of the overhead vapor portion in the soaking zone should be less than 1 minute and will typically be between 0.2 and 0.8 minutes. Short residence time may be attained by appropriate vapor space design and, preferably, with use of stripping steam to the soaker. The overhead vapor portion in its entirety is introduced directly to an intermediate point of a fractionation zone for recovery of a diesel range fuel product. The fractionation zone may be a distillation tower of conventional design. Mechanical design of the system should be characterized by low residence time between the soaking zone and the fractionation zone.

The heavy oil liquid portion is recovered from the soaking zone. This portion is a suitable feedstock to downstream cracking operations such hydrocracking or fluid catalytic cracking for production of high octane gasoline. Depending, however, upon the feedstock to the soaking zone, the liquid portion recovered therefrom may still contain enough diesel fraction to warrant recovery in the fractionation zone. In one embodiment of the invention, therefore, the liquid portion from the soaking zone is introduced to a catalytic cracking unit for the production of gasoline. In another embodiment of the invention, the liquid portion from the soaking zone is introduced directly to the fractionation zone at a point below the intermediate point thereof at which the overhead vapor portion is introduced. The bulk of the liquid portion processed in this manner passes through the bottom of the fractionator so that a major portion of the heavy oil recovered from the soaking zone is introduced to the downstream catalytic cracking unit.

As previously indicated, many aspects of the process of the invention are at least in part feedstock related. One such aspect is undesirable coke formation which is principally a temperature and time phenomenon but is also feedstock related. We have found in instances of coking tendency that coking problems may be significantly minimized by recycle of heavy hydrocarbons to the soaking zone. Therefore, in another embodiment of the invention, a recycle stream boiling above 345° C., preferably between 400° C. and 510° C., may be recovered from the fractionation zone and introduced to the soaking zone. Typically, this recycle stream will be from 20 to 50 weight percent of the fresh feed to the soaking zone.

Figure 3:
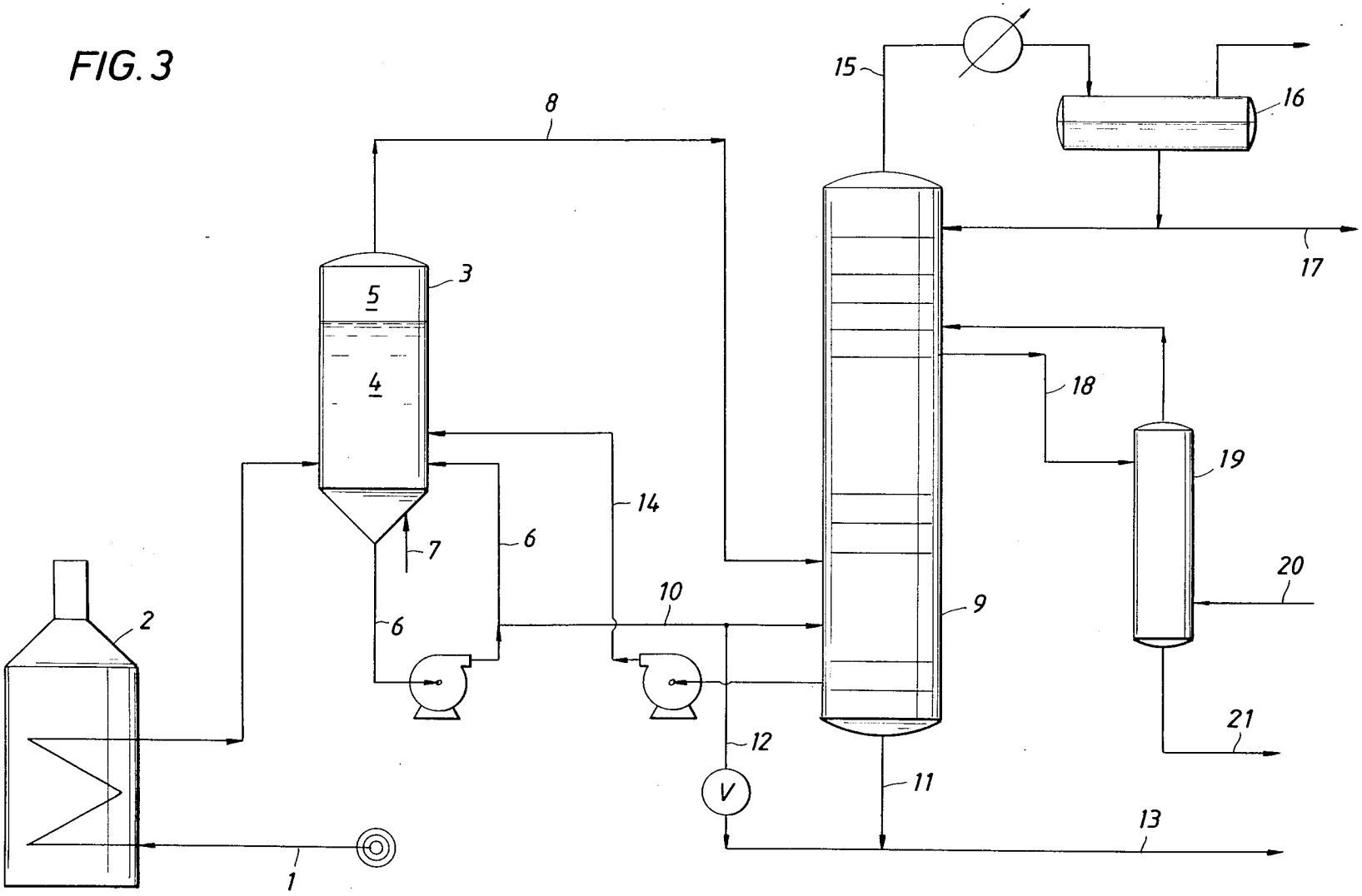
FIG. 3 is an exemplary flow diagram for carrying out the process of the invention.

Referring now to FIG. 3, 113,400 kg/hr. of vacuum gas oil having an initial boiling point of 345° C. and an end point of 565° C. is introduced through line 1 to coil furnace 2, heated to 495° C., and discharged to soaker 3 which contains liquid phase 4 and vapor phase 5. The soaker is recirculated by pump-around 6, operates at 413° C., and has a vapor zone pressure of 2.09 kg/cm$^2$ abs. Heavy oil is maintained in the soaker for a residence time equivalent to 2 hours on a fresh feed basis and is thermally cracked to a vapor portion comprised principally of hydrocarbons boiling in the diesel fuel range with a lesser amount of light ends and gases. Vapor evolution is aided by stripping steam introduced to the soaker at 7 in order to quickly remove the vaporized diesel fraction from the soaker as well as to reduce the hydrocarbon partial pressure therein.

The vapor portion from the soaker containing most of the desired diesel fraction is introduced via line 8 directly to an intermediate point of fractionator 9. A forward flow of 68,000 kg/hr. of heavy oil is removed from pump-around 6 and introduced via line 10 to the fractionator to extract a small amount of diesel range material remaining in the liquid portion removed from the soaker. Most of this stream will pass through the lower part of the fractionator and be removed as bottoms stream 11. With some feedstocks, the amount of diesel found in the liquid portion will be negligible and the liquid portion may by-pass the fractionator via line 12 to line 13. The hydrocarbon liquid in line 13 is subsequently employed as feedstock to a fluid catalytic cracking unit (not shown) for the production of gasoline. A slip-stream boiling between 400° C. and 510° C. in the amount of 40 weight percent of the fresh feed in line 1 is removed from fractionator 9 and recycled through line 14 to soaker 3 in order to reduce coke formation in the system.

Hydrocarbons within and above the naphtha range are removed as fractionator overhead through line 15, cooled, and separated in 16. Gases are removed from the separator while 10,500 kg/hr. of hydrocrbons boiling in the gasoline range are removed via line 17.

Hydrocarbons within the diesel fuel range are removed from the fractionator via line 18 to stripper 19 where steam introduced at 20 strips off excessively light material. 29,000 kg/hr. of diesel fuel having an API number of 35.2° is removed via line 21 for blending or subsequent desulfurization. The ratio of diesel to gasoline range product is 2.8 based on a diesel/gasoline cut-point of 193° C.

We claim:

1. A continuous process for production of diesel range fuel which comprises:

(a) heating virgin hydrocarbon oil having a Conradson carbon content below 2 weight percent and boiling predominantly above 345° C. to incipient cracking conditions and introducing the resulting heated oil to a back-mixed, soaking zone having a vapor zone and a liquid zone, a temperature between 385° C. and 440° C., and a vapor zone pressure between 1.38 and 3.84 kg/cm$^2$ abs.;

(b) cracking the heated oil in the liquid zone in the absence of added hydrogen to a diesel-rich, overhead vapor portion and a heavy oil liquid portion while maintaining the liquid portion in the soaking zone for an average residence time equivalent to between 1 and 4 hours based on fresh feed and maintaining the overhead vapor portion in the soaking zone for a residence time less than 1 minute;

(c) introducing all of the diesel-rich, overhead vapor portion directly to an intermediate point of a fractionation zone;

(d) recovering a diesel range fuel product from the fractionation zone; and (e) recovering the heavy oil liquid portion from the soaking zone.

2. The process of claim 1 wherein the heavy oil liquid portion recovered from the soaking zone is introduced directly to the fractionation zone at a point below the intermediate point of the fractionation zone.

3. The process of either claim 1 or claim 2 wherein at least a major portion of the heavy oil liquid portion recovered from the soaking zone is introduced to a catalytic cracking unit for the production of gasoline.

4. The process of either claim 1 or claim 2 wherein a recycle stream boiling above 345° C. is recovered from the fractionation zone and introduced to the soaking zone.

5. The process of claim 1 or claim 2 wherein the hydrocarbon partial pressure in the soaking zone is reduced by introduction of stripping steam to the soaking zone.

6. The process of either claim 1 or claim 2 wherein the virgin hydrocarbon oil is vacuum gas oil boiling predominantly between 345° C. and 565° C.

* * * * *